US007090152B2

(12) United States Patent
Kobayashi et al.

(10) Patent No.: US 7,090,152 B2
(45) Date of Patent: Aug. 15, 2006

(54) FUEL INJECTOR AND METHOD OF MANUFACTURING THE SAME

(75) Inventors: Nobuaki Kobayashi, Gunma (JP); Hideo Kato, Tochigi (JP); Hiroshi Okada, Gunma (JP)

(73) Assignee: Hitachi Ltd., Tokyo-to (JP)

( * ) Notice: Subject to any disclaimer, the term of this patent is extended or adjusted under 35 U.S.C. 154(b) by 173 days.

(21) Appl. No.: 10/918,452

(22) Filed: Aug. 16, 2004

(65) Prior Publication Data

US 2005/0023384 A1 Feb. 3, 2005

Related U.S. Application Data

(62) Division of application No. 10/097,606, filed on Mar. 15, 2002, now Pat. No. 6,805,309.

(30) Foreign Application Priority Data

Mar. 16, 2001 (JP) ..... 2001-076875
Mar. 19, 2001 (JP) ..... 2001-078752

(51) Int. Cl.

| | |
|---|---|
| ***F02M 59/00*** | (2006.01) |
| ***F02M 47/02*** | (2006.01) |
| ***F02M 61/00*** | (2006.01) |
| ***B05B 1/30*** | (2006.01) |
| ***F02D 1/06*** | (2006.01) |

(52) U.S. Cl. ..... 239/533.2; 239/88; 239/585.1; 239/585.5; 239/533.9; 239/533.12; 239/5

(58) Field of Classification Search ..... 239/533.2, 239/5, 88–92, 533.3, 533.1, 533.8, 533.9, 239/533.12, 585.1–585.5; 251/129.15, 129.21; 29/890.124, 890.127

See application file for complete search history.

(56) References Cited

U.S. PATENT DOCUMENTS

| | | | | |
|---|---|---|---|---|
| 5,392,995 | A * | 2/1995 | Wahba | 239/585.4 |
| 5,417,373 | A * | 5/1995 | Facchin | 239/585.3 |
| 5,692,723 | A | 12/1997 | Baxter et al. | |
| 5,783,261 | A | 7/1998 | Potter et al. | |
| 5,927,613 | A | 7/1999 | Koyanagi et al. | |
| 5,979,786 | A * | 11/1999 | Longman et al. | 239/5 |
| 6,062,499 | A | 5/2000 | Nakamura et al. | |

FOREIGN PATENT DOCUMENTS

| | | |
|---|---|---|
| JP | 11-6467 | 1/1999 |
| JP | 2000-8990 | 1/2000 |
| JP | 2001-27169 | 1/2001 |

* cited by examiner

*Primary Examiner*—Davis Hwu
(74) *Attorney, Agent, or Firm*—Sughrue Mion, PLLC

(57) ABSTRACT

A fuel injector including a tubular casing having an axial fuel passage. Disposed within the fuel passage are a valve seat element, a core cylinder, and a valve element axially moveably disposed therebetween and opposed to the core cylinder with an axial air gap. An electromagnetic actuator cooperates with the casing, the valve element and the core cylinder to form a magnetic field forcing the valve element to the open position against a spring between the valve element and the core cylinder upon being energized. The casing includes a reluctance portion producing an increased magnetic reluctance and allowing the magnetic field to extend to the valve element and the core cylinder through the air gap. The reluctance portion has a reduced radial thickness and an axial length extending over the air gap.

6 Claims, 11 Drawing Sheets

FUEL INJECTOR AND METHOD OF MANUFACTURING THE SAME

This is a divisional of Application No. 10/097,606 filed Mar. 15, 2002 now U.S. Pat. No. 10/097,606. The entire disclosure(s) of the prior application(s), application number(s) 10/097,606 is considered part of the disclosure of the accompanying Divisional application and is hereby incorporated by reference.

BACKGROUND OF THE INVENTION

The present invention relates to fuel injectors suitably used for injecting fuel to an engine, for instance, an automobile engine.

Generally, fuel injectors used for automobile engines include a tubular casing having an axial fuel passage and made of magnetic metal. A valve seat is disposed at one end of the fuel passage and has a fuel outlet. A core cylinder is disposed within the fuel passage in axially spaced relation to the valve seat. A valve element is axially moveably disposed within the fuel passage. An electromagnetic actuator is provided for forcing the valve element to an open position upon being energized. In the open position, the valve element is out of contact with the valve seat to allow fluid to be injected through the fuel outlet.

Japanese Patent Application First Publication No. 11-6467 discloses such an electromagnetically operated fuel injector. The fuel injector of this related art also includes a casing, a core cylinder axially opposed to the valve element with an axial air gap, and a non-magnetic joint disposed between the casing and the core cylinder. When the electromagnetic actuator is energized, a magnetic field extends to the core cylinder and the valve element via the axial air gap, so that the valve element is attracted by the core cylinder and moved to the open position. The non-magnetic joint suppresses a short-cut of the magnetic field which will be caused between the casing and the core cylinder. If the short-cut is caused, the magnetic field will form a closed magnetic circuit without passing through the axial air gap between the core cylinder and the valve element. This will cause reduction of the magnetic force acting on the valve element and the core cylinder.

Japanese Patent Application First Publication No. 2000-8990 also discloses an electromagnetically operated fuel injector of the same type as described above. The fuel injector includes a casing formed by a metal pipe, and an annular non-magnetic portion disposed in an axial-middle position of the casing. Upon energizing the electromagnetic actuator, the annular non-magnetic portion prevents the short-cut of the magnetic field. The annular non-magnetic portion is formed by subjecting the axial-middle portion of the metal pipe to heat treatment, for instance, induction heating.

Japanese Patent Application First Publication No. 2001-27169 discloses such an electromagnetically operated fuel injector of the same type as described above. The fuel injector includes a tubular casing having a fuel outlet at one axial end portion thereof, a resin cover covering an opposite axial end portion of the casing, a seal disposed on near the one axial end portion of the casing, and a resin protector for protecting the one axial end portion of the casing and the seal. Upon manufacturing the fuel injector, the parts such as a valve seat, a valve element, a core cylinder and an electromagnetic actuator are mounted to the casing, and the resin cover is formed by injection molding. An axial air gap (a valve lift amount) between the valve element and the core cylinder is adjusted using a tool. After the adjustment work, the resin protector previously molded is mounted onto the one axial end portion of the casing together with the seal.

SUMMARY OF THE INVENTION

Upon manufacturing the fuel injector of Japanese Patent Application First Publication No. 11-6467 described above, a forming work of the non-magnetic joint and the core cylinder and an assembly work thereof necessitate relatively much time and effort. This is because the non-magnetic joint and the core cylinder have engaging portions engageable with each other upon assembling, which complicate the shapes of the joint and the core cylinder. This will deteriorate the productivity and increase the number of parts, leading to a complicated structure of the fuel injector and reduction in reliability thereof. In the fuel injector of Japanese Patent Application First Publication No. 2000-8990 described above, the casing tends to suffer from thermal deformation which will be caused by the heat treatment. This will cause slight distortion and warping in the casing, causing erroneous assembly of the parts such as the valve element, the core cylinder and the electromagnetic actuator. Also, it is likely that, upon operating the fuel injector, the valve element fails to smoothly move within the casing due to the distortion and warping of the casing. Further, upon manufacturing the fuel injector of Japanese Patent Application First Publication No. 2001-27169 described above, the protector must be separately molded and be mounted onto the casing after the adjustment of the axial air gap between the valve element and the core cylinder for facilitating the adjustment work. Much time and effort are required to form the protector in a molding process separated from the assembly line, and then mount the molded protector onto the casing. This leads to deterioration in productivity of the fuel injector.

The present invention contemplates to solve the above-described disadvantages or problems of the related arts. Specifically, it is an object of the present invention to provide a fuel injector using a partially magnetically interrupted casing, which has a simple structure with a reduced number of parts and is improved in productivity and reliability. Also, it is an object of the present invention to provide a method of manufacturing the fuel injector, in which the partially magnetically interrupted casing is readily formed with high accuracy by general machining, and the resin protector is formed and mounted to the casing in a simple manufacturing line of the fuel injector, serving for reducing the number of parts and improving the working efficiency upon assembling.

According to one aspect of the present invention, there is provided a fuel injector, comprising:

a tubular casing defining an axial fuel passage;

a valve seat element disposed within said axial fuel passage, said valve seat element defining a fuel outlet communicated with said axial fuel passage;

a valve element axially moveable within said axial fuel passage between an open position where said valve element is out of contact with said valve seat element to allow fluid communication between said axial fuel passage and said fuel outlet and a closed position where said valve element is in contact with said valve seat element to block the fluid communication;

a core cylinder axially opposed to said valve element with an axial air gap;

a spring biasing said valve element toward the closed position, said spring being disposed within said axial fuel passage; and an electromagnetic actuator cooperating with said casing, said valve element and said core cylinder to form a magnetic field forcing said valve element to the open position against said spring upon being energized, said casing being formed with a reluctance portion producing an increased magnetic reluctance and allowing the magnetic field to pass through the axial air gap between said valve element and said core cylinder, said reluctance portion having a reduced radial thickness and an axial length extending over the axial air gap.

According to a further aspect of the present invention, there is provided a method of manufacturing a fuel injector, the fuel injector including a tubular casing having an axial fuel passage, a valve seat element disposed within the fuel passage at one axial end portion of the casing, an electromagnetic actuator disposed on the casing, a core cylinder axially spaced from the valve seat element, a valve element axially moveable between the valve seat element and the core cylinder and opposed to the core cylinder with an axial air gap, the casing cooperating with the core cylinder and the valve element to form a magnetic field upon energizing the electromagnetic actuator, the casing including a reluctance portion which has a reduced radial thickness and an axial length extending over the axial air gap, the method comprising:

forming an annular groove on an entire circumferential surface of a pipe made of magnetic material to provide the tubular casing formed with the reluctance portion;

fixing the valve seat element into an inner circumferential surface of the one axial end portion of the casing;

fixing the electromagnetic actuator onto an outer circumferential surface of the casing; and mounting the valve element and the core cylinder into the casing so as to be opposed to each other with the axial air gap to provide the fuel injector.

Other objects and features of this invention will become understood from the following description with reference to the accompanying drawings.

BEST MODE FOR CARRYING OUT THE INVENTION

Figure 1:
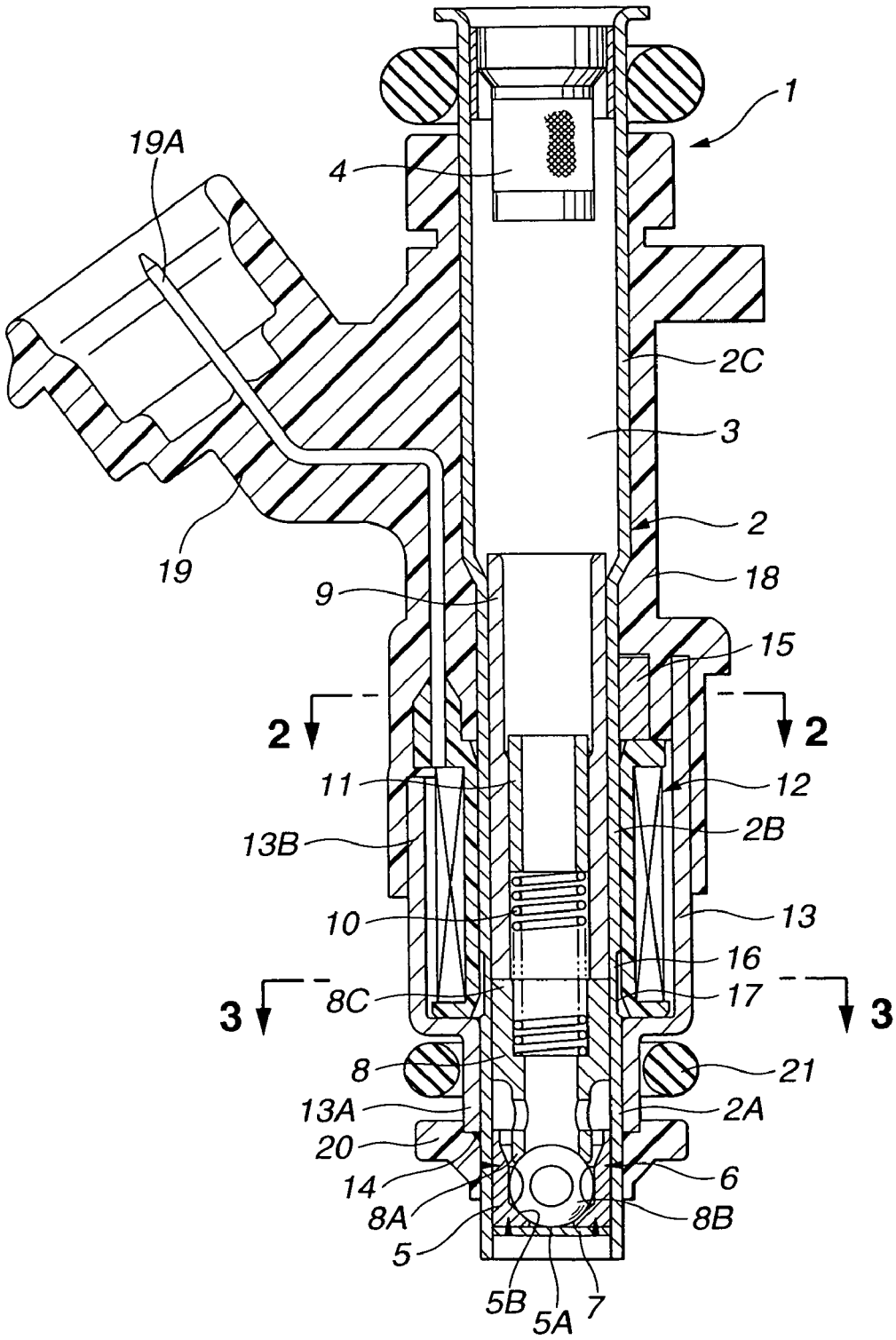
FIG. 1 is a longitudinal cross section of a fuel injector according to a first embodiment of the present invention.
Figure 5:
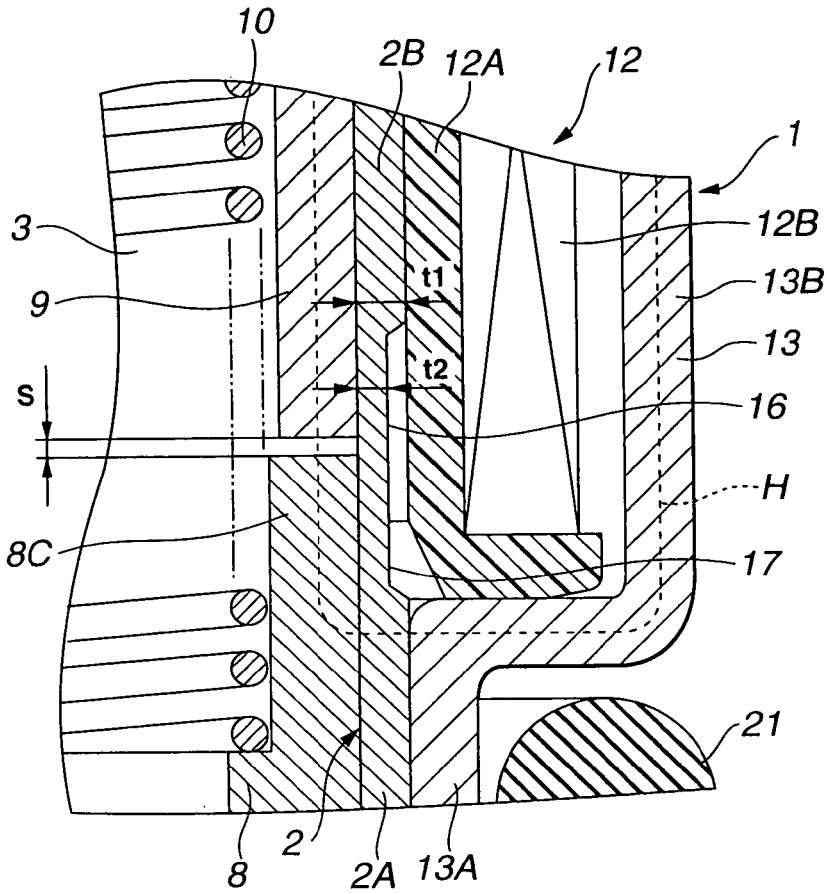
FIG. 5 is a partially enlarged view of FIG. 4, showing a vicinity of a radially thinned portion of a tubular casing of the fuel injector.
Figure 6:
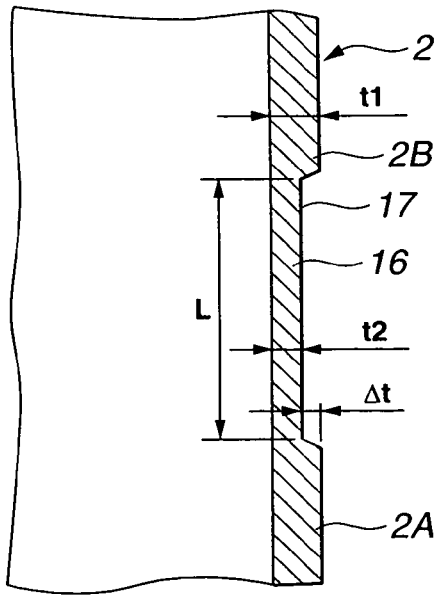
FIG. 6 is a partially enlarged view similar to FIG. 5, but showing the radially thinned portion of the casing.
Figure 7:
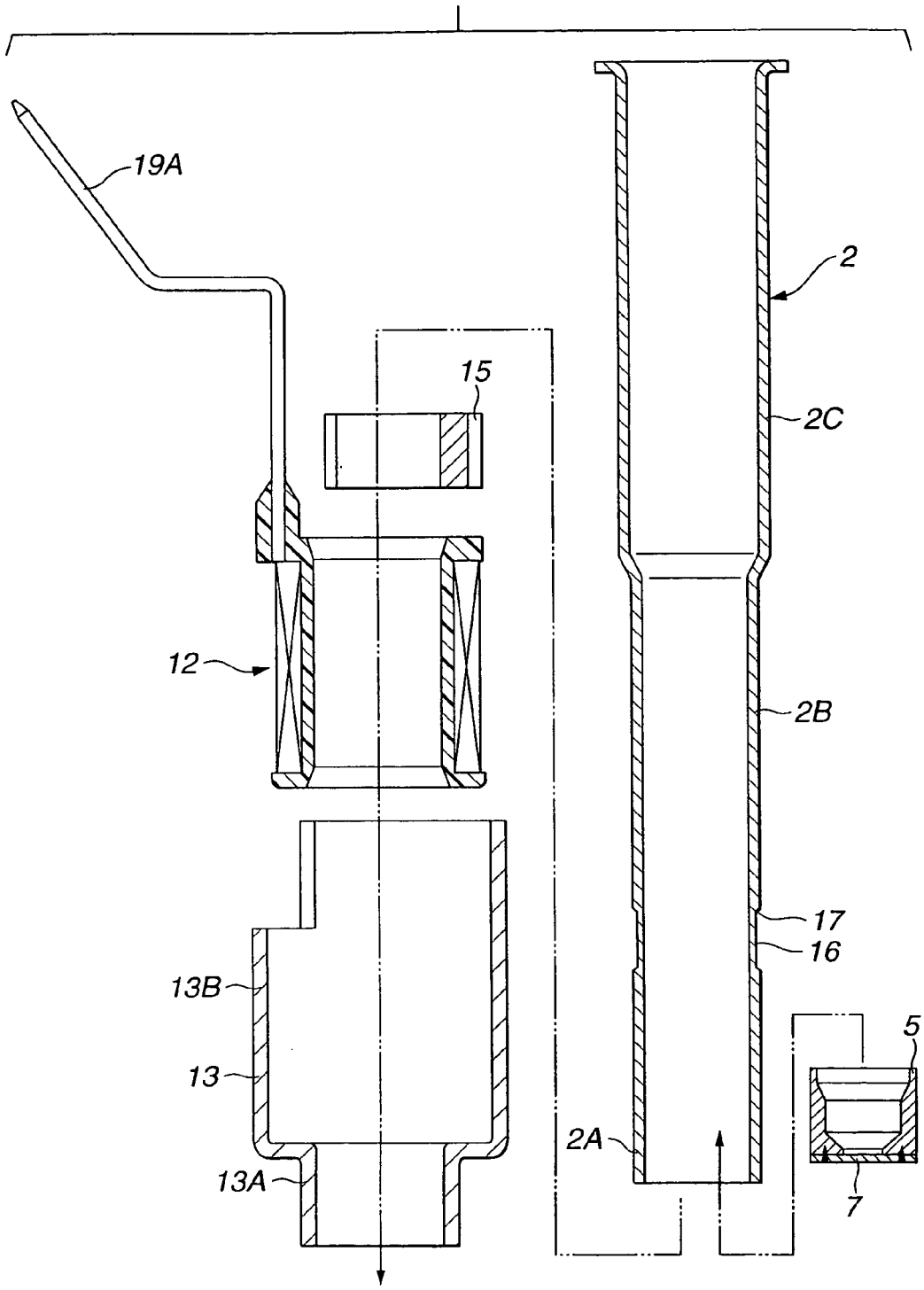
FIG. 7 is an exploded view, taken in longitudinal section, of a unit assembly including the casing, a valve seat element, an electromagnetic actuator, an actuator cover and a connecting core.

Referring to FIGS. 1–11, a fuel injector of a first embodiment of the present invention will be explained hereinafter, which may be incorporated to an automobile engine. As illustrated in FIG. 1, the fuel injector has injector housing 1 as an outer shell, which includes tubular casing 2, actuator cover 13 and resin cover 18. Casing 2 is a main body of injector housing 1 and formed by a pipe made of magnetic material such as metal, for instance, electromagnetic stainless steel. Casing 2 has a shape of a stepped cylinder as shown in FIGS. 1 and 7. Casing 2 includes a wall defining axial fuel passage 3 in the form of an axial bore. Casing 2 includes valve receiving portion 2A, core cylinder receiving portion 2B, reluctance portion 16, and fuel supply portion 2C, which are coaxially arranged. Axial fuel passage 3 extends through valve receiving portion 2A, core cylinder receiving portion 2B, reluctance portion 16, and fuel supply portion 2C. Valve receiving portion 2A receives valve element 8 and valve seat element 5 as explained later. Core cylinder receiving portion 2B receives core cylinder 9 as explained later. Valve receiving portion 2A and core cylinder receiving portion 2B have substantially same inner diameter. Reluctance portion 16 is interposed between valve receiving portion 2A and core cylinder receiving portion 2B and receives a part of each of valve element 8 and core cylinder 9. Fuel supply portion 2C is disposed axially adjacent to core cylinder receiving portion 2B. Fuel supply portion 2C has a larger inner diameter than that of valve receiving portion 2A and core cylinder receiving portion 2B. Fuel filter 4 is mounted to fuel supply portion 2C, through which fuel is supplied to fuel passage 3.

As illustrated in FIGS. 5 and 6, valve receiving portion 2A and core cylinder receiving portion 2B of casing 2 have predetermined thickness (radial dimension) t1. Predetermined thickness t1 is within a range of about 0.2 mm to about 10.0 mm, and preferably, within a range of about 0.2 mm to about 3.0 mm. Reluctance portion 16 between valve receiving portion 2A and core cylinder receiving portion 2B produces an increased magnetic reluctance when electromagnetic actuator 12 is energized to move valve element 8 to an open position as explained later. Reluctance portion 16 is formed by annular groove 17 circumferentially extending on an entire outer circumferential surface of casing 2 between valve receiving portion 2A and core cylinder receiving portion 2B. Groove 17 has a generally rectangular shaped section taken along the axial direction of casing 2. Reluctance portion 16 has predetermined thickness t2 less than thickness t1 of valve receiving portion 2A and core cylinder receiving portion 2B. Difference between thickness t1 and thickness t2 is indicated by $\Delta t$ as shown in FIG. 6. Predetermined thickness is within a range of about 0.1 mm to about 9.0 mm, and preferably, within a range of about 0.1 mm to about 2.8 mm. Difference $\Delta t$ is not less than 0.1 mm. Reluctance portion 16 has predetermined axial length L extending over axial air gap S between valve element 8 and core cylinder 9. Reluctance portion 16 has predetermined length L larger than axial air gap S. Predetermined length L is within a range of about 2 mm to about 20 mm.

Figure 4:
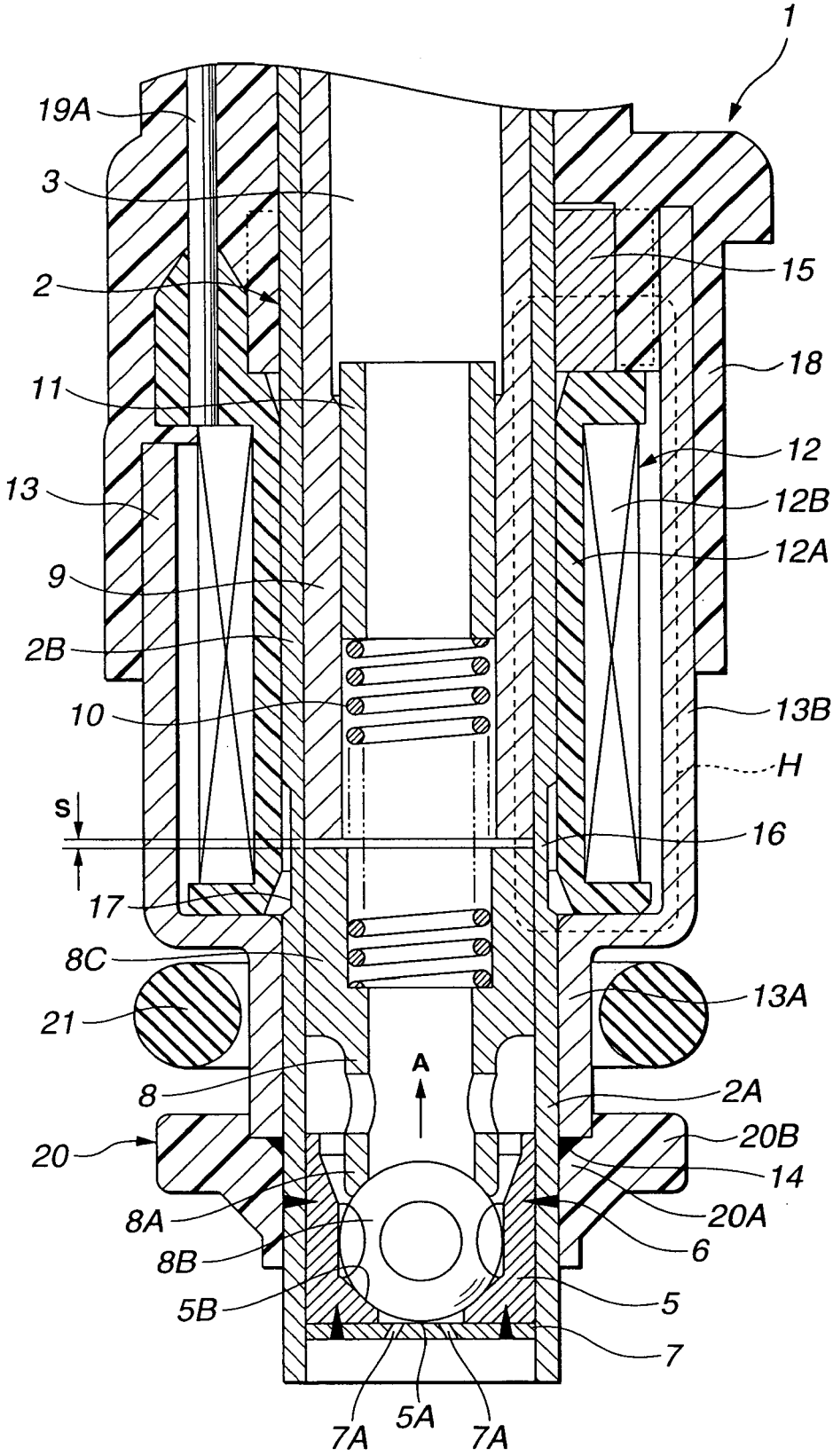
FIG. 4 is a partially enlarged view of FIG. 1, showing a distal end of the fuel injector.

Referring back to FIG. 1, valve seat element 5 is disposed within axial fuel passage 3 in valve receiving portion 2A of casing 2. Valve seat element 5 having a generally cylindrical shape is fitted to one axial end portion of valve receiving portion 2A. As illustrated in FIG. 4, valve seat element 5 defines fuel outlet 5A open to an axial end face thereof, through which fuel within axial fuel passage 3 is injected to the outside. Valve seat element 5 includes valve seat 5B having a generally conical surface which surrounds fuel outlet 5A. Valve element 8 comes into contact with valve seat 5B so as to close fuel outlet 5A and prevent the fuel from being injected from fuel outlet 5A. Valve seat element 5 is fixed to valve receiving portion 2A at entire circumferential weld 6 as shown in FIG. 4. Nozzle plate 7 is fixed to the axial end face of valve seat element 5 so as to cover fuel outlet 5A. Nozzle plate 7 is formed with a plurality of through-holes 7A.

Valve element 8 is axially moveable within axial fuel passage 3 in valve receiving portion 2A of casing 2. Valve element 8 includes axially extending valve shaft 8A, generally spherical valve body 8B fixed to an axial end of valve shaft 8A, and attraction cylinder 8C disposed on an opposite axial end of valve shaft 8A and made of magnetic material such as metal. In this embodiment, attraction cylinder 8C is integrally formed with valve shaft 8A. Valve element 8 has a closed position shown in FIG. 4, where valve body 8B is in contact with valve seat 5B of valve seat element 5 to block fluid communication between axial fuel passage 3 and fuel outlet 5A, and an open position where valve body 8B is out of contact with valve seat 5B to allow the fluid communication between axial fuel passage 3 and fuel outlet 5A. At the closed position, there is axial air gap S between opposed axial end faces of attraction cylinder 8C and core cylinder 9. Axial air gap S has a preset value determined depending on a diameter of holes 7A of nozzle plate 7. Axial air gap S may be 300 μm at maximum. Valve element 8 is moved from the closed position to the open position along a direction indicated at A in FIG. 4, upon energizing electromagnetic actuator 12 as described later.

Core cylinder 9 made of magnetic material such as metal is press-fitted to core cylinder receiving portion 2B of casing 2. Spring 10 is fixed into core cylinder 9 by a suitable method such as press-fitting. Spring 10 is disposed between spring seat 11 and valve element 8 in a compressed state and always biases valve element 8 toward the closed position.

Electromagnetic actuator 12 is generally disposed on an outer circumferential surface of core cylinder receiving portion 2B of casing 2. An axial end portion of electromagnetic actuator 12 is located on reluctance portion 16. As illustrated in FIG. 4, electromagnetic actuator 12 includes bobbin 12A and coil 12B wound on bobbin 12A. Electromagnetic actuator 12 cooperates with casing 2, valve element 8, core cylinder 9, actuator cover 13, and connecting core 15 to form magnetic field H, upon being energized through terminal pins 19A of connector 19 connected with coil 12B as shown in FIG. 1. Specifically, magnetic field H is formed along a closed magnetic circuit defined by valve receiving portion 2A and core cylinder receiving portion 2B of casing 2, attraction cylinder 8C of valve element 8, axial air gap S, core cylinder 9, actuator cover 13, and connecting core 15.

Figure 2:
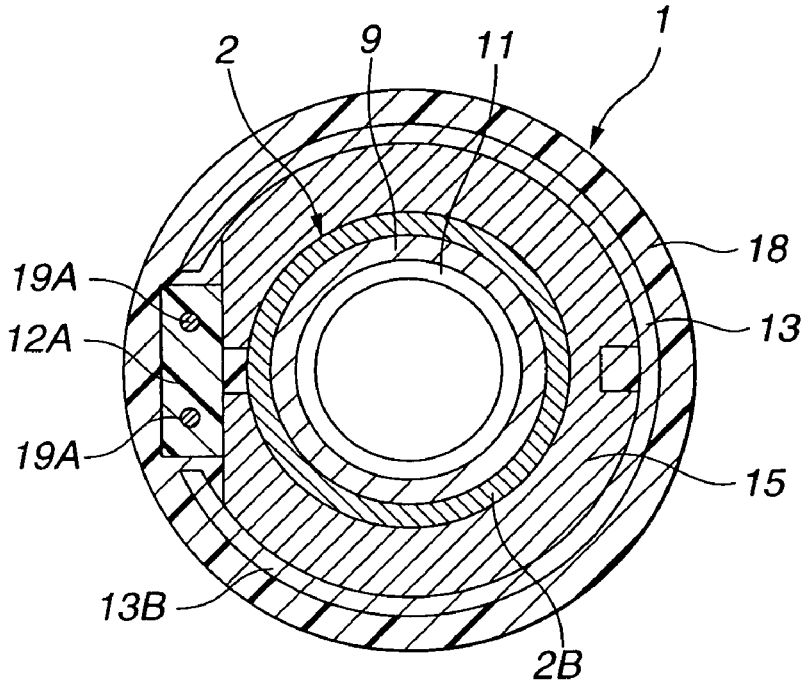
FIG. 2 is an enlarged cross section taken along line 2—2 shown in FIG. 1.
Figure 3:
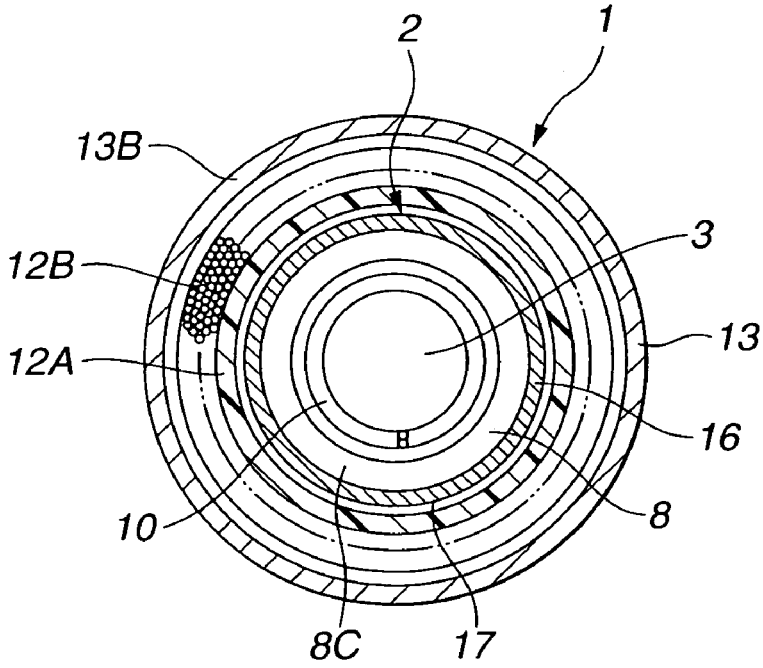
FIG. 3 is an enlarged cross section taken along line 3—3 shown in FIG. 1.

Actuator cover 13 is made of magnetic material such as metal and formed into a stepped cylindrical shape. Actuator cover 13 includes mount portion 13A mounted to valve receiving portion 2A of casing 2, and cover portion 13B receiving electromagnetic actuator 12. An axial end of mount portion 13A is fixed at annular weld 14 to an entire outer circumferential surface of valve receiving portion 2A. Cover portion 13B extends radially outwardly from mount portion 13A and along an outer circumferential surface of electromagnetic actuator 12 so as to cover electromagnetic actuator 12. Cover portion 13B has a larger diameter than a diameter of mount portion 13A and is integrally formed with mount portion 13A. Connecting core 15 is fitted onto the outer circumferential surface of core cylinder receiving portion 2B of casing 2 in axially adjacent relation to electromagnetic actuator 12. Connecting core 15 made of magnetic material such as metal has a generally C-shape as shown in FIG. 2. Upon energizing electromagnetic actuator 12, connecting core 15 magnetically connects core cylinder receiving portion 2B and cover portion 13B of actuator cover 13 to form a part of the magnetic circuit along the outer surface of electromagnetic actuator 12.

When magnetic field H is formed upon energizing electromagnetic actuator 12, valve receiving portion 2A and core cylinder receiving portion 2B of casing 2 are substantially magnetically interrupted by reluctance portion 16. This is because reluctance portion 16 has a cross-sectional area smaller than that of each of valve receiving portion 2A and core cylinder receiving portion 2B, causing an increased magnetic reluctance therein. Owing to the magnetic interruption between valve receiving portion 2A and core cylinder receiving portion 2B by reluctance portion 16, magnetic field H is radially inwardly introduced and extends to attraction cylinder 8C of valve element 8 and core cylinder 9 through axial air gap S therebetween. Attraction cylinder 8C of valve element 8 is attracted by core cylinder 9 and moves to the open position.

Referring back to FIG. 1, resin cover 18 envelopes fuel supply portion 2C and core cylinder receiving portion 2B of casing 2 and large-diameter portion 13B of actuator cover 13. Resin cover 18 is formed by resin molding. Connector 19 is integrally formed with resin cover 18, in which each terminal pin 19A for energizing coil 12B of electromagnetic actuator 12 is embedded.

Figure 8:
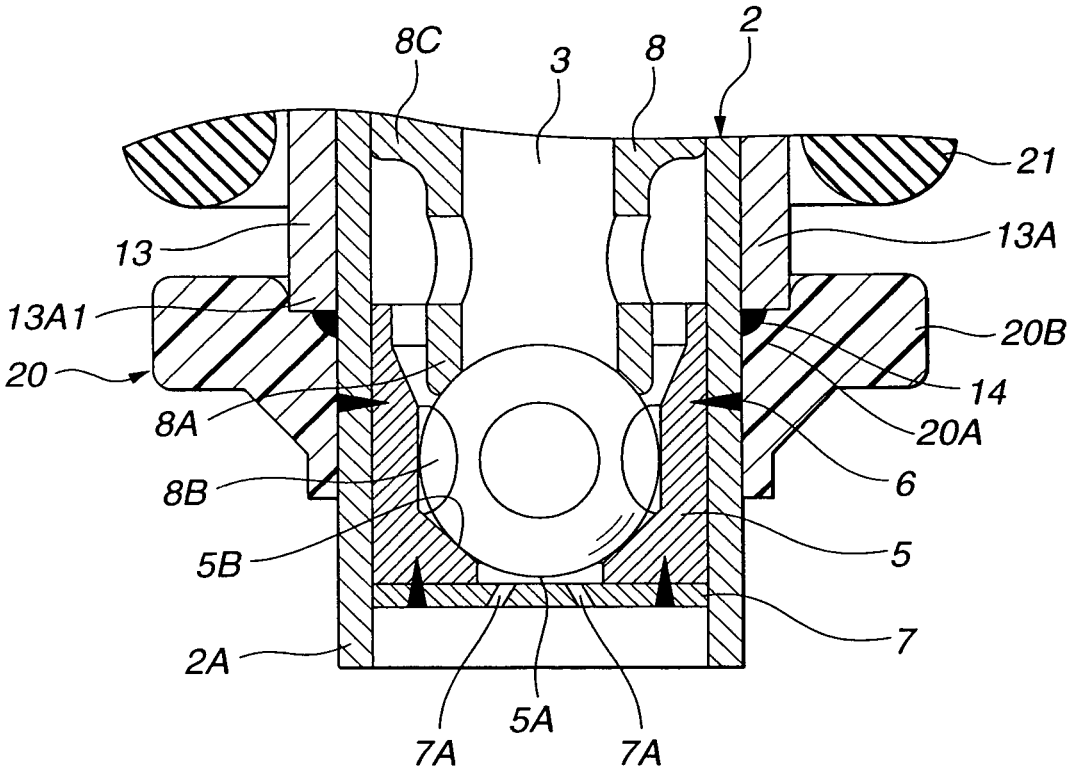
FIG. 8 is a partially enlarged view of FIG. 1, showing a protector at the distal end of the fuel injector.
Figure 9:
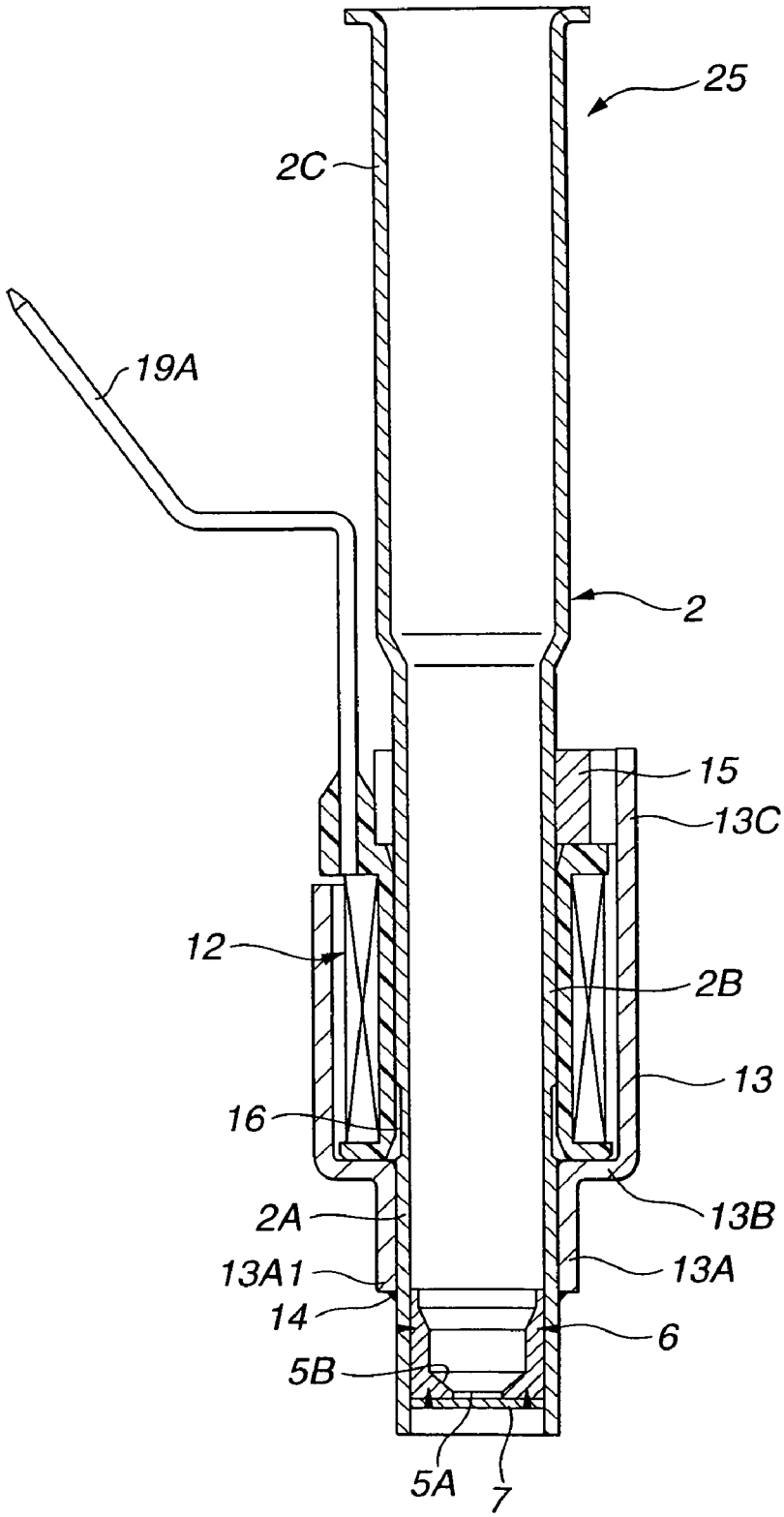
FIG. 9 is a longitudinal cross section of the unit assembly casing the casing, the valve seat element, the electromagnetic actuator, the actuator cover and the connecting core.

As best shown in FIG. 8, protector 20 is disposed on the axial end portion of valve receiving portion 2A of casing 2 which receives valve seat element 5 therein. Protector 20 having an annular shape is made of same resin material as that of cover 18. Protector 20 includes hub portion 20A fixed to the outer circumferential surface of the axial end portion of valve receiving portion 2A, and flange portion 20B radially outwardly extending from hub portion 20A. Hub portion 20A circumferentially covers weld junction 14 between axial end portion 13A1 of mount portion 13A of actuator cover 13 and the outer circumferential surface of valve receiving portion 2A. Hub portion 20A prevents the entry of foreign substances such as dust and water present in an intake air introduced to an intake pipe of an engine to which the fuel injector is mounted. Even if weld bead forms steps or protrusions on the surface of weld junction 14, hub portion 20A can ensure sealing at weld junction 14. Flange portion 20B retains seal 21 mounted onto mount portion 13A of actuator cover 13. Seal 21 covers a clearance between the axial end portion of valve receiving portion 2A and a mounting site, for example, a boss portion provided on the intake pipe, to which the axial end portion of valve receiving portion 2A is mounted. In this embodiment, seal 21 is in the form of an O-ring. Flange portion 20B has an outer diameter larger than an inner diameter of seal 21 and prevents seal 21 from removing from the axial end portion of valve receiving portion 2A. As best shown in FIG. 4, seal 21 is retained between flange portion 20B of protector 20 and a shoulder portion between mount portion 13A and cover portion 13B of actuator cover 13.

An operation of the thus-constructed fuel injector now is explained. Fuel is supplied to fuel passage 3 within casing 2 through fuel filter 4. When coil 12B of electromagnetic actuator 12 is activated with a current supplied through terminal pins 19A of connector 19, magnetic field H is produced to extend to attraction cylinder 8C of valve element 8 and core cylinder 9 through axial air gap S as shown in FIG. 4. Magnetic attraction is caused between valve element 8 and core cylinder 9, forcing valve element 8 to move from the closed position to the open position against the force of spring 10. At the open position, valve body 8B is out of contact with valve seat 5B of valve seat element 5, so that the fuel within fuel passage 3 is sprayed from fuel outlet 5A into the intake pipe of the engine.

With the arrangement of reluctance portion 16 of casing 2, magnetic reluctance generated upon energizing electromagnetic actuator 12 can be increased at reluctance portion 16. Since reluctance portion 16 extends on the entire outer circumferential surface of casing 2, the magnetic reluctance can be stably increased over the entire circumference of reluctance portion 16. The increased magnetic reluctance can reduce magnetic conduction between valve receiving portion 2A and core cylinder receiving portion 2B of casing 2, so that valve receiving portion 2A and core cylinder receiving portion 2B can be substantially magnetically interrupted. At this time, magnetic field H formed can be prevented from being axially short-cut between valve receiving portion 2A and core cylinder receiving portion 2B and can be allowed to pass through air gap S between valve element 8 and core cylinder 9. As a result, magnetic force can be sufficiently applied to valve element 8 so that valve element 8 can be stably driven to the open position.

Referring to FIGS. 7 and 9–11, a method of manufacturing the fuel injector will be explained hereinafter. First, a pipe made of magnetic material such as metal is prepared. As shown in FIG. 7, the pipe has small inner diameter portion to be used as valve receiving portion 2A and core cylinder receiving portion 2B of casing 2, and large inner diameter portion to be used as fuel supply portion 2C of casing 2. Annular groove 17 is formed by machining, for instance, pressing or cutting, on an outer circumferential surface of the pipe to provide reluctance portion 16. Casing 2 is thus formed.

Next, electromagnetic actuator 12 connected with terminal pins 19A, actuator cover 13 and connecting core 15 are fitted onto casing 2. Then, axial end portion 13A1 of mount portion 13A of actuator cover 13 is fixed at weld 14 shown in FIG. 9, to the entire outer circumferential surface of valve receiving portion 2A. Valve seat element 5 and nozzle plate 7 welded thereto is fitted into casing 2 and then fixed at weld 6 shown in FIG. 9, to the entire inner circumferential surface of valve receiving portion 2A. Unit assembly 25 including casing 2, valve seat element 5, electromagnetic actuator 12, actuator cover 13 and connecting core 15 is thus provided.

Figure 10:
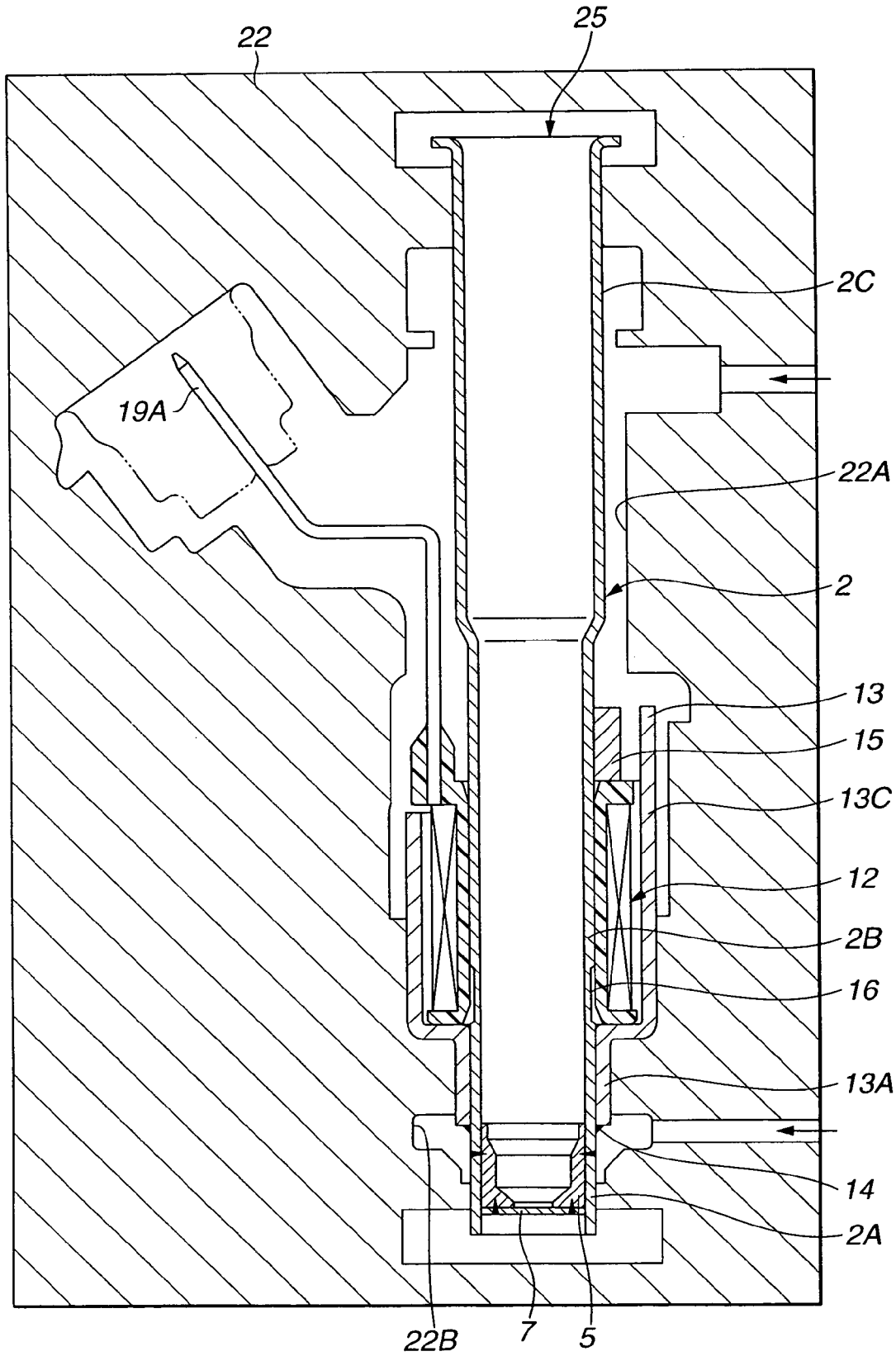
FIG. 10 is a longitudinal cross section of the unit assembly placed in a mold upon forming a cover and the protector by injection molding.

Subsequently, cover 18, connector 19 and protector 20 are formed by injection molding. As illustrated in FIG. 10, unit assembly 25 is placed in mold 22 formed with cover molding portion 22A and protector molding portion 22B. First molding portion 22A is formed corresponding to cover 18 and connector 19, and second molding portion 22B is formed corresponding to protector 20. Resin material is injected into first molding portion 22A and second molding portion 22B to substantially simultaneously form cover 18, connector 19 and protector 20 and fix cover 18, connector 19 and protector 20 to casing 2.

Figure 11:
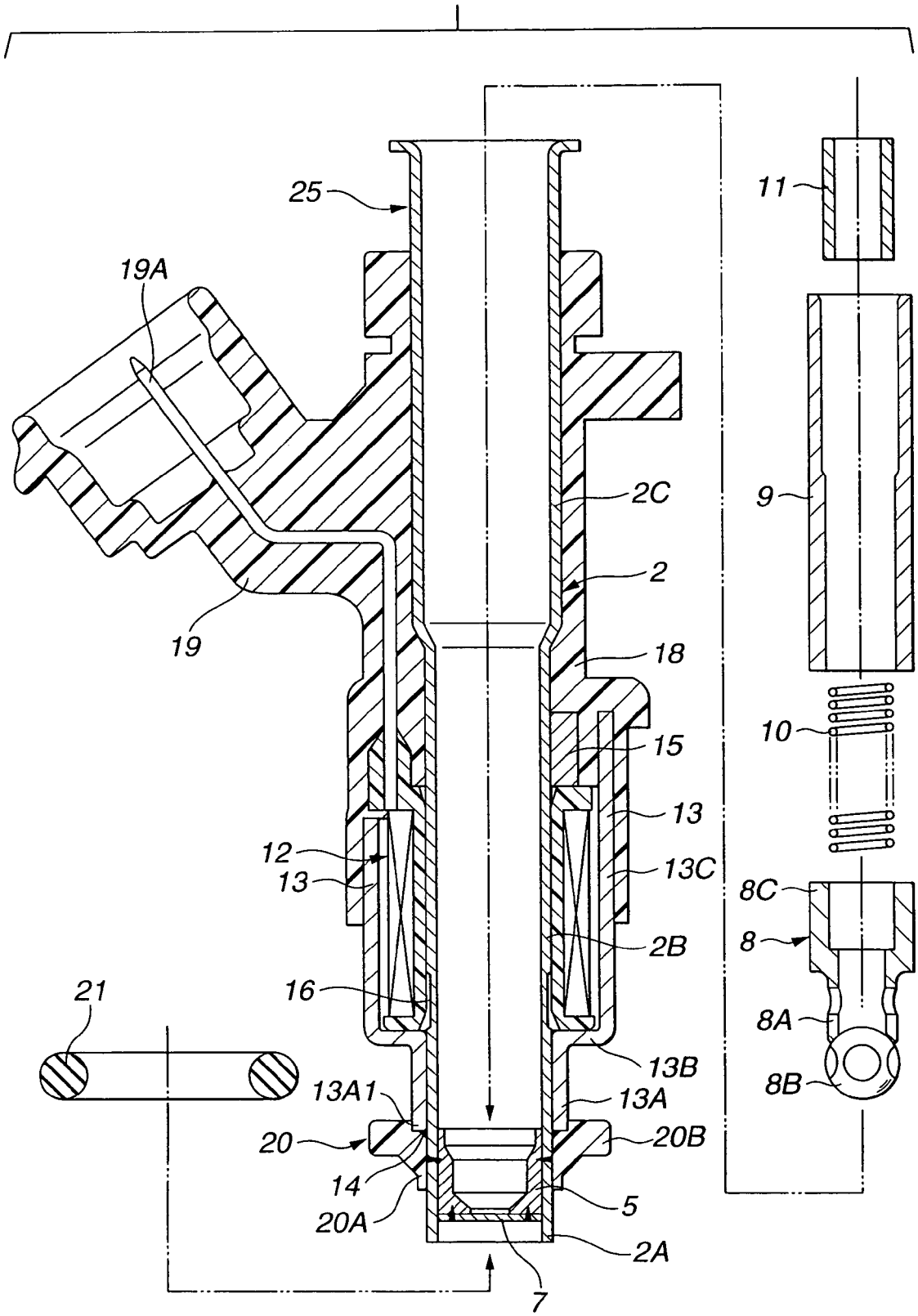
FIG. 11 is an explanatory diagram showing the unit assembly with the cover and the protector, to which the valve element, a core cylinder, a spring, a spring seat and a seal are mounted.

Next, as illustrated in FIG. 11, valve element 8, core cylinder 9, spring 10 and spring seat 11 are mounted into casing 2 and placed in their predetermined axial positions within casing 2. At this time, an amount of lift of valve element 8 is adjusted to a preset value by varying axial air gap S between attraction portion 8C and core cylinder 9. Then, seal 21 is mounted onto hub portion 13A of actuator cover 13 on the axial end portion of valve receiving portion 2A of casing 2. Thus, the fuel injector is provided.

Upon manufacturing the fuel injector of the invention, casing 2 is integrally formed from the pipe made of magnetic material such as metal, and reluctance portion 16 is readily provided by forming annular groove 17 on the entire circumferential surface of casing 2 by general machining such as pressing and cutting. This manufacturing method can reduce the number of parts of the fuel injector and can attain the simple structure.

Further, it is not required to use a non-magnetic joint or subject the casing to heat treatment for forming a non-magnetic portion as proposed in the above-described related arts. This can reduce the number of parts of the fuel injector, serving for facilitating the assembly work and improving the productivity. Furthermore, valve receiving portion 2A and core cylinder receiving portion 2B of casing 2 can be prevented from suffering from distortion and warping which will be caused if casing 2 is subjected to the heat treatment for forming the non-magnetic portion. Valve receiving portion 2A and core cylinder receiving portion 2B, therefore, can be formed with high accuracy, thereby allowing valve seat element 5, valve element 8, core cylinder 9 and electromagnetic actuator 12 to be assembled to casing 2 without failure. Upon operating the fuel injector, valve element 8 can be stably moved between the closed and open positions. This serves for enhancing reliability of the fuel injector.

Further, cover 18, connector 19 integrally formed with cover 18, and protector 20, which may be made of same resin material, are simultaneously formed by injection molding as explained above. Thus, molding of cover 18, connector 19 and protector 20 and assembling thereof to casing 2 are carried out in the single injection molding process. This can eliminate separate molding of protector 20 as an individual part and separate assembling thereof to casing 2 by hand, serving for reducing the number of parts and enhancing efficiency of the assembly work. Thus, the productivity of the fuel injector can be improved. Furthermore, cover 18 and protector 20 can be readily formed using a mold that can be produced by slightly modifying the configuration of a conventional mold.

The present invention is not limited to the embodiments described above. Reluctance portion 16 can be formed in the inner circumferential surface of casing 2. Groove 17 defining reluctance portion 16 can be formed into another shape, for instance, an arcuate shape in section taken along the axial direction of casing 2. Upon manufacturing the fuel injector, valve seat element 5 may be press-fitted to the axial end portion of casing 2 after assembling the unit assembly including casing 2, electromagnetic actuator 12, actuator cover 13 and connecting core 15, and injection molding cover 18 and protector 20.

Figure 12:
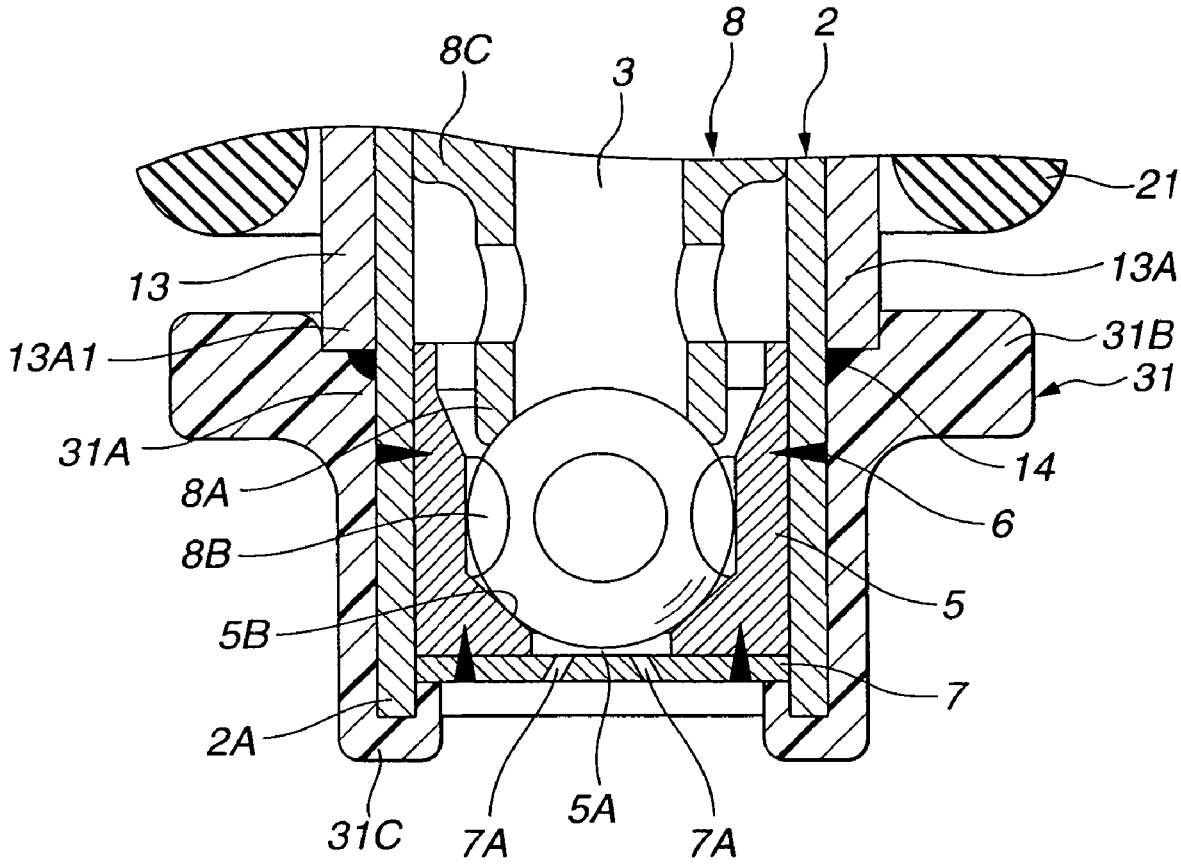
FIG. 12 is a view similar to FIG. 8, but showing the protector of the fuel injector of a second embodiment.

Referring to FIG. 12, a second embodiment of the invention will be explained, in which protector 31 is modified from protector 20 of the first embodiment. Like reference numerals denote like parts, and therefore, detailed explanations therefor will be omitted. As illustrated in FIG. 12, similar to protector 20 of the first embodiment, protector 31 is mounted onto the axial end portion of valve receiving portion 2A of casing 2. Protector 31 is made of the same resin material as that of cover 18 and formed by injection molding together with cover 18. Protector 31 includes mount portion 31A fixed to the outer circumferential surface of the axial end portion of valve receiving portion 2A, flange portion 31B radially outwardly extending from mount portion 31A, and turnover portion 31C which is connected with mount portion 31A and covers an axial end face of valve receiving portion 2A. As shown in FIG. 12, turnover portion 31C axially downwardly extends from mount portion 31A along the outer circumferential surface of the axial end portion of valve receiving portion 2A, and radially inwardly extends along the axial end of valve receiving portion 2A to cover the axial end face thereof. Turnover portion 31C then extends axially upwardly along the inner circumferential surface of valve receiving portion 2A. Turnover portion 31C thus has a generally C-shape. The second embodiment can exhibit substantially the same effect as that of the first embodiment. Further, in this embodiment, the axial end of valve receiving portion 2A can be protected by turnover portion 31C from impingement of foreign substances thereon and any damage caused by the impingement. This can enhance durability of the fuel injector.

Figure 13:
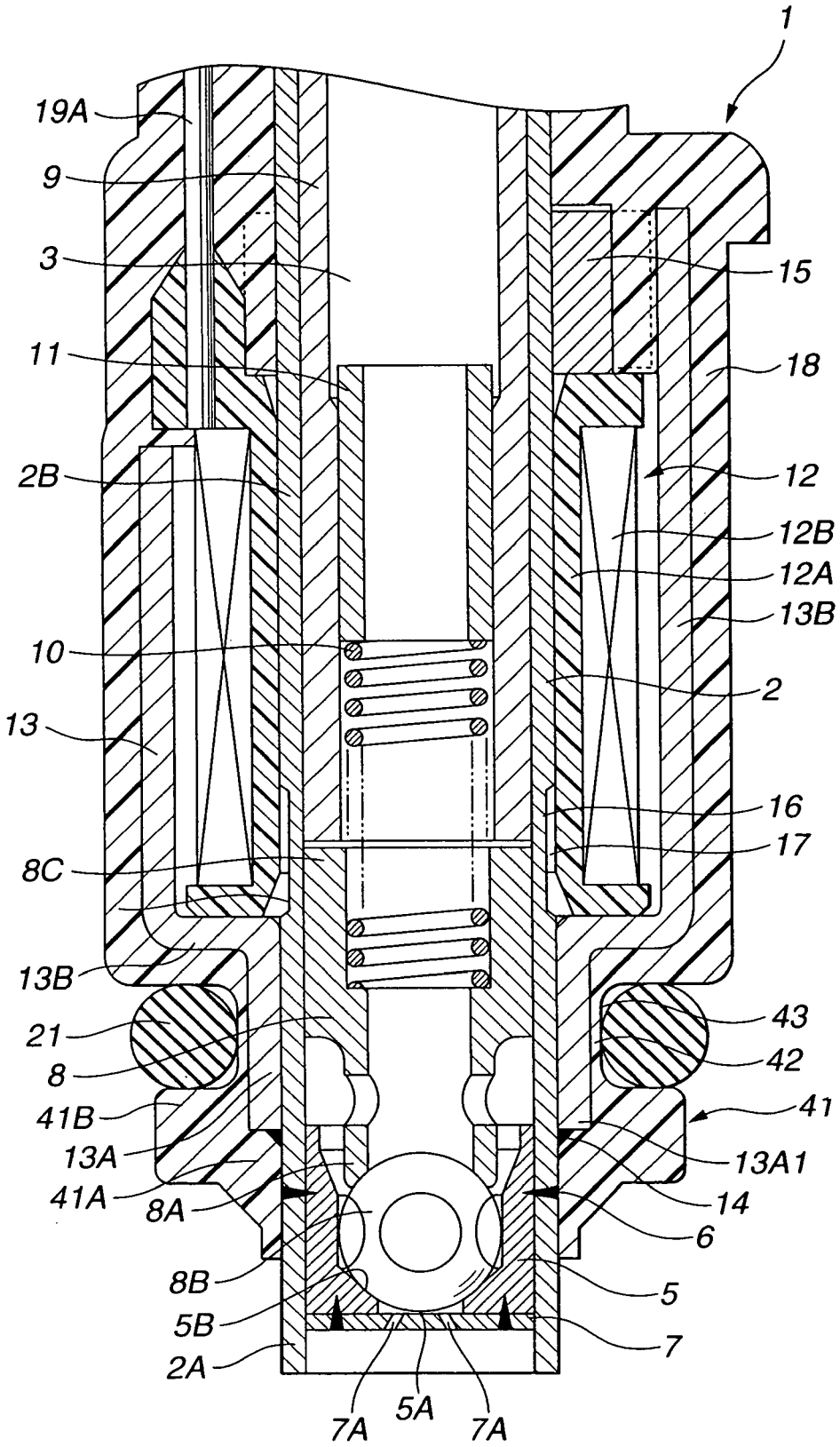
FIG. 13 is a view similar to FIG. 4, but showing the fuel injector of a third embodiment.

Referring to FIG. 13, a third embodiment of the invention will be explained, in which protector 41 is integrally formed with cover 18. As illustrated in FIG. 13, protector 41 includes mount portion 41A fixed to the outer circumferential surface of the axial end portion of valve receiving portion 2A of casing 2, and flange portion 41B radially outwardly extending from mount portion 41A. Protector 41 also includes connecting portion 42 through which protector 41 is coupled with cover 18. Connecting portion 42 extends from flange portion 41B along an outer circumferential surface of each of hub portion 13A and cover portion 13B of actuator cover 13 and is connected with cover 18. Connecting portion 42 thus has a stepped cylindrical shape and forms annular outer groove 43 into which seal 21 is fitted. Protector 41 is made of the same resin material as cover 18 and integrally formed with cover 18 in the same injection molding process. The third embodiment can exhibit substantially the same effect as that of the first embodiment. Further, in this embodiment, protector 41 integrally formed with cover 18 can ensure the strength, serving for improving reliability of the fuel injector.

Meanwhile, the present invention is not limited to the fuel injectors using the valve element 8 including a spherical valve body 11 as described in the above embodiments, and it may be applied to fuel injectors using a needle valve element including a conical valve body.

The entire contents of basic Japanese Patent Applications No. 2001-076875, filed on Mar. 16, 2001, and No. 2001-078752, filed on Mar. 19, 2001, the priority of which are claimed, are herein incorporated by reference.

The invention claimed is:

1. A method of manufacturing a fuel injector, the fuel injector including a tubular casing having an axial fuel passage, a valve seat element disposed within the fuel passage at one axial end portion of the casing, an electromagnetic actuator disposed on the casing, a core cylinder axially spaced from the valve seat element, a valve element axially moveable between the valve seat element and the core cylinder and opposed to the core cylinder with an axial air gap, the casing cooperating with the core cylinder and the valve element to form a magnetic field upon energizing the electromagnetic actuator, the casing including a reluctance portion which has a reduced radial thickness and an axial length extending over the axial air gap, the method comprising:

forming an annular groove on an entire circumferential surface of a pipe made of magnetic material to provide the tubular casing formed with the reluctance portion;

fixing the valve seat element into an inner circumferential surface of the one axial end portion of the casing;

fixing the electromagnetic actuator onto an outer circumferential surface of the casing; and mounting the valve element and the core cylinder into the casing so as to be opposed to each other with the axial air gap to provide the fuel injector.

2. The method as claimed in claim 1, wherein the fuel injector includes a protector disposed on the one axial end portion of the casing and a cover extending over an opposite axial end portion of the casing and the electromagnetic actuator, the method further comprising injection molding the cover and the protector substantially simultaneously.

3. The method as claimed in claim 2, wherein the injection molding is performed after the fixing of the valve seat element and the fixing of the electromagnetic actuator and before the mounting of the valve element and the core cylinder.

4. The method as claimed in claim 2, wherein the injection molding is performed after the fixing of the electromagnetic actuator and before the fixing of the valve seat element and the mounting of the valve element and the core cylinder.

5. The method as claimed in claim 1, wherein the forming of the annular groove is performed by either of pressing or cutting.

6. The method as claimed in claim 1, wherein the fuel injector includes an actuator cover extending over the electromagnetic actuator and made of magnetic material, a connecting core connecting the actuator cover with the casing and made of magnetic material, and a spring biasing the valve element toward the valve seat element, the method further comprising fixing the actuator cover and the connecting core onto the outer circumferential surface of the casing, the mounting of the valve element and the core cylinder comprising mounting the spring between the valve element and the core cylinder.

* * * * *